US008651890B2

(12) United States Patent
Chiarelli

(10) Patent No.: US 8,651,890 B2
(45) Date of Patent: Feb. 18, 2014

(54) ELECTRICAL CONNECTOR HAVING SPRING CLIP ASSIST CONTACT

(75) Inventor: Davide Chiarelli, Rivoli (IT)

(73) Assignee: Tyco Electronics AMP Italia S.R.L., Collegno (Turin) (IT)

( * ) Notice: Subject to any disclaimer, the term of this patent is extended or adjusted under 35 U.S.C. 154(b) by 35 days.

(21) Appl. No.: 13/196,702

(22) Filed: Aug. 2, 2011

(65) Prior Publication Data

US 2012/0034810 A1 Feb. 9, 2012

(30) Foreign Application Priority Data

Aug. 4, 2010 (IT) ..... TO2010A0677

(51) Int. Cl.
*H01R 13/62* (2006.01)

(52) U.S. Cl.
USPC ..... 439/370; 439/835

(58) Field of Classification Search
USPC ..... 439/370, 436, 441, 729, 828, 834, 835
See application file for complete search history.

(56) References Cited

U.S. PATENT DOCUMENTS

| | | | | |
|---|---|---|---|---|
| 3,579,283 | A * | 5/1971 | Welburn | 439/325 |
| 4,350,403 | A * | 9/1982 | Seytre et al. | 439/325 |
| 4,767,340 | A | 8/1988 | Hohorst | |
| 4,768,981 | A * | 9/1988 | Hohorst | 439/835 |
| 6,004,168 | A * | 12/1999 | Fuchs et al. | 439/835 |
| 6,126,494 | A * | 10/2000 | Fuchs et al. | 439/835 |
| 7,648,403 | B2 * | 1/2010 | Rueggen et al. | 439/828 |
| 2003/0066673 | A1 | 4/2003 | Doutaz | |

FOREIGN PATENT DOCUMENTS

| | | | |
|---|---|---|---|
| DE | 3447135 | A1 | 5/1986 |
| DE | 19753076 | C1 | 8/1999 |
| DE | 102008048087 | A1 | 4/2010 |
| EP | 1744402 | A1 | 1/2007 |
| EP | 2048740 | A1 | 4/2009 |
| WO | WO 2010/069673 | A1 | 6/2010 |

OTHER PUBLICATIONS

Search Report issued by Ministero dello Sviluppo Economico (Ministry of Economic Development, Italian Patent & Trademark Office), dated Feb. 18, 2011 for Italian Patent Application No. IT TO20100677; 9 pages.

* cited by examiner

*Primary Examiner* — Thanh-Tam T. Le
(74) *Attorney, Agent, or Firm* — Faegre Baker Daniels LLP

(57) ABSTRACT

An electric connector is described which provides direct contact between an electric conductor and a respective counterpart. The connection is locked in place by means of one or more spring clips, for example associated with a casing. In a variant a single common casing is provided for the direct connection between a plurality of electric conductors and respective counterparts, which may be contact elements which are also associated with respective electric conductors or bump contacts of a PCB. In a further variant the counterpart is also an electric conductor, in such a way that direct contact is produced between two electric conductors held in mutual engagement by one or more spring clips.

10 Claims, 14 Drawing Sheets

ELECTRICAL CONNECTOR HAVING SPRING CLIP ASSIST CONTACT

BACKGROUND

The present invention relates to electric connectors of the type comprising at least one first and one second contact element which can be coupled to one another, wherein the first contact element is connected to a respective electric conductor, and wherein the second contact element is also connected to a respective electric conductor or else is a contact of a printed circuit board.

A conventional electric connector of the type specified above, which is able to form the connection between two electric conductors, is illustrated by way of example in FIG. 1.

Referring to FIG. 1, number 1 denotes as a whole the electric connector, which comprises a first receptacle-shaped contact element 2 and a second plug-shaped contact element 3. The two contact elements 2, 3 are formed from sheet metal and can be coupled to one another in the state shown in the figure to form the electric connection. Referring to the example shown, each of the two metal contact components 2, 3 is carried by a respective plastics material casing denoted by 4 and 5 respectively. Furthermore, the distal ends of the two contact elements 2, 3 are respectively connected to the ends, which do not have the respective insulating sheath, of electric conductors 6, 7 each formed by a conventional strand of conductive metal wires, for example copper.

The total electrical resistance of an electric connection of the type illustrated in FIG. 1 is formed by three different components:

- the "permanent" resistance, which is caused by the parts denoted in the figure by "$R_{Permanent}$", that is to say by the connections between electric conductors and contact elements, and corresponds to approximately 0.1% of the total resistance,
- the "bulk" resistance, which is caused by the same contact elements 2, 3, denoted by "$R_{Bulk}$" in the figure, and forms the majority of the total resistance, and
- the contact resistance, denoted by "$R_{Contact}$" in the figure, corresponding to the resistance caused by the contact between the two elements 2, 3, this resistance also being rather low at approximately 1% of the total resistance.

The object of the present invention is therefore to provide an electric connector of the type specified above which has a considerably reduced total electrical resistance so as to reduce heating of the connector during use as a result, and which has the resulting advantage of reduced deterioration, a longer service life and a greater reliability of the connection.

SUMMARY

The basic idea upon which the invention is based consists in eliminating the "bulk" resistance by forming a direct contact between at least one electric conductor and the respective counterpart.

The present invention therefore relates to an electric connector having the features indicated at the beginning of the present description and further wherein the aforementioned first contact element is formed by a portion of the respective electric conductor and a spring clip is provided to hold said portion of electric conductor in engagement with the further contact element.

In one embodiment said portion of electric conductor which forms the first contact element is received inside a casing with which the aforementioned spring clip is associated.

In a variant of said embodiment a plurality of pairs of said first and second contact elements is provided, and a common casing is provided which receives the portions of electric conductor forming the first contact elements of the various pairs. In one embodiment the aforementioned common casing is prearranged with a plurality of spring clips associated with the various portions of conductor forming the first contact elements. In a variant the common casing is prearranged with a single spring clip which is common to all the pairs.

If the second contact element is also connected to an electric conductor, the aforementioned casing which receives the portion of conductor forming the first contact element has a receptacle for receiving the second contact element.

If, instead, the second contact element is a contact of a printed circuit board, the aforementioned casing has a receptacle for receiving a portion of said circuit board. If a spring clip is provided for each pair of contact elements, the aforementioned casing has an opening from which an end of each spring clip emerges, said spring clip being movable between a loaded position, in which the clip allows insertion, inside the casing, of the aforementioned portion of electric conductor forming the first contact element, and a released position, in which the clip locks the portion of electric conductor inside the casing. If, instead, a single spring clip is associated with the housing which is common to more pairs of contact elements, said spring clip is arranged outside a deformable portion of the casing which thus acts as an element capable of insulating the spring clip against the contact elements.

In accordance with yet a further embodiment the second contact element is also formed by a respective portion of electric conductor and the aforementioned electric connector is devoid of a casing and comprises a single spring clip or a pair of spring clips prearranged to hold in mutual engagement the two portions of electric conductor which are coupled to one another.

BRIEF DESCRIPTION OF THE DRAWINGS

The invention will now be described with reference to the accompanying drawings, which are provided by way of non-limiting example and in which.

DETAILED DESCRIPTION

Figure 1:
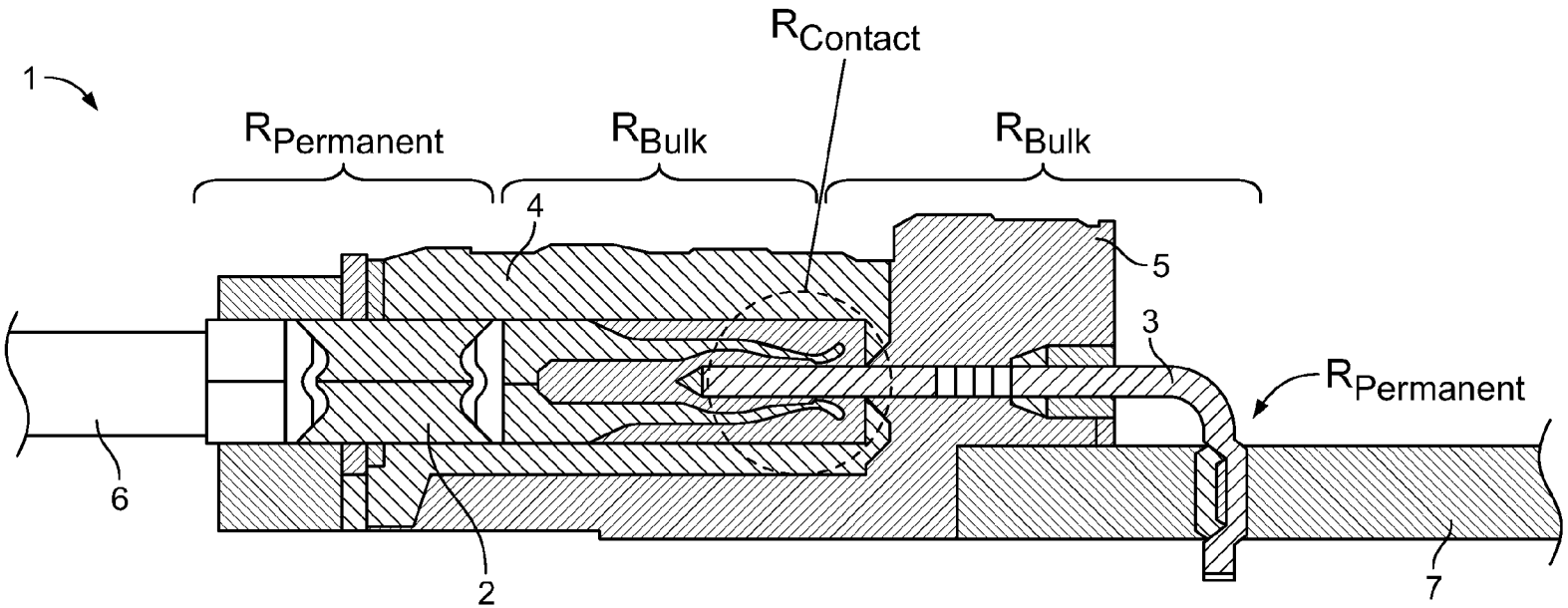
Fig. 1 PRIOR ART
FIG. 1 is a schematic sectional view of an electric connector according to the conventional type described above.
Figure 2:
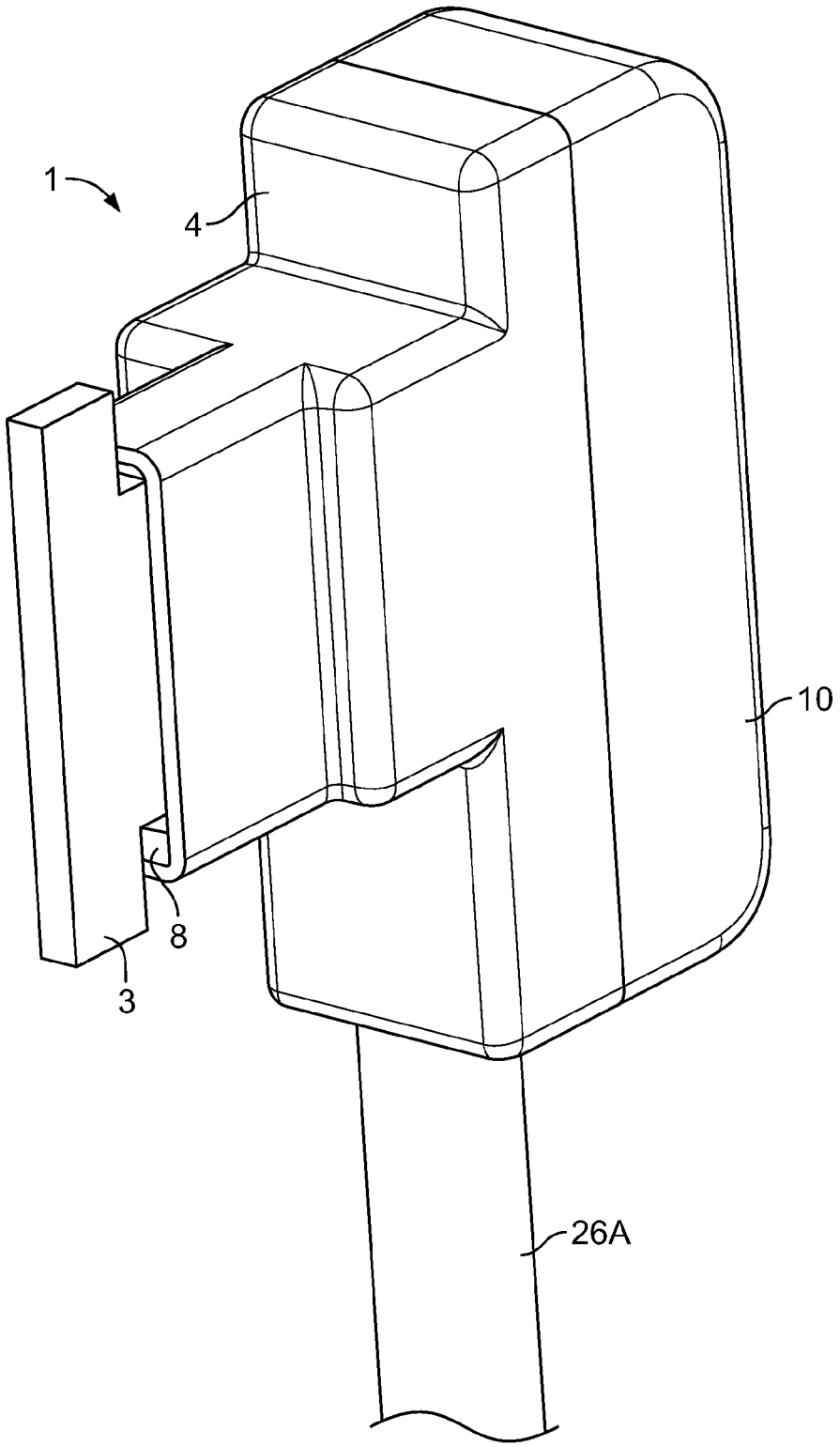
FIG. 2 is a perspective view of an electric connector according to a first embodiment of the invention in the closed state.
Figure 3:
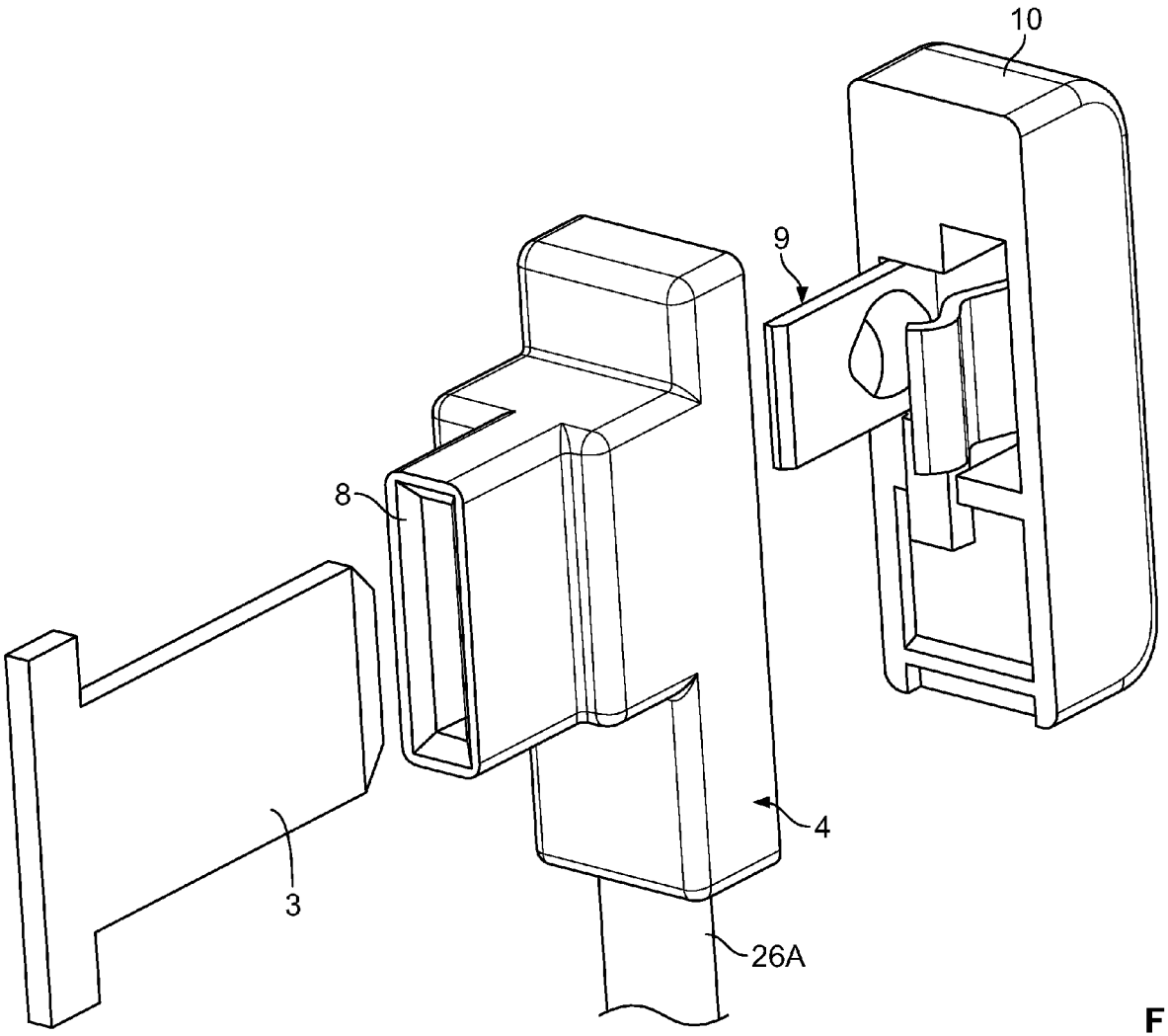
FIG. 3 is a perspective exploded view of the connector of FIG. 2.
Figure 4:
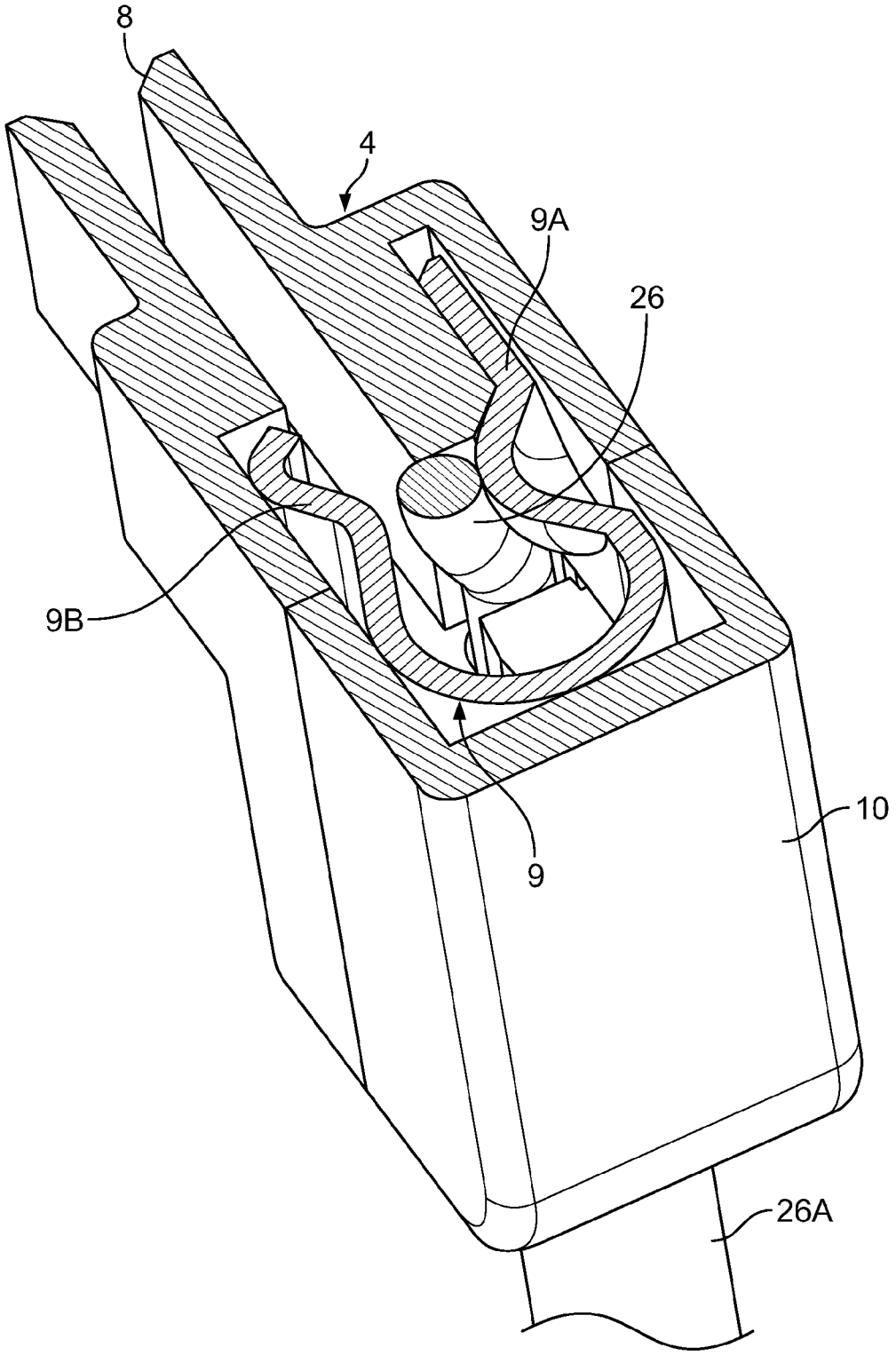
FIG. 4 is a sectional view of the connector of FIG. 2.

FIGS. 2-4 show a first preferred embodiment of the invention in which a connector 1 comprises a first contact element 26 (FIG. 4) which is formed by a stripped portion of electric conductor protruding at one end from an insulating sheath 26A. The second contact element forming the counterpart which cooperates directly with the electric conductor 26 is formed by a metal contact element 3, which is a flat tongue in the example illustrated and is in turn to be connected to a second electric conductor (not shown in the drawings). The terminal portion of the sheath 26*a* with the portion of electric conductor 26 protruding therefrom is received inside a plastics material casing 4 having a mouth 8 which is shaped to receive the second contact element 3. As can be seen in FIG. 3, in the example illustrated the directions of insertion of the counterpart 3 and of the electric conductor 26 are orthogonal to one another. Once these parts have been inserted into the casing 4, the connection is ensured by means of a spring clip 9 which is carried by an auxiliary plastics material member 10 which can be coupled to the casing 4. As can be seen in FIG. 4, the spring clip 9 is formed by a metal strip which is bent in a U-shape with a branch defining a protrusion 9A which presses the portion of electric conductor 26 against the counterpart 3 (not shown in FIG. 4) and against the further branch 9B of the spring clip 9, which is formed with a V-shaped profile extending towards the branch 9A.

As is evident from the description above, in the connector 1 of FIGS. 2-4 the first of the contact elements is formed by the same electric conductor 26, the metal contact element which is normally associated therewith being eliminated completely.

Figure 5:
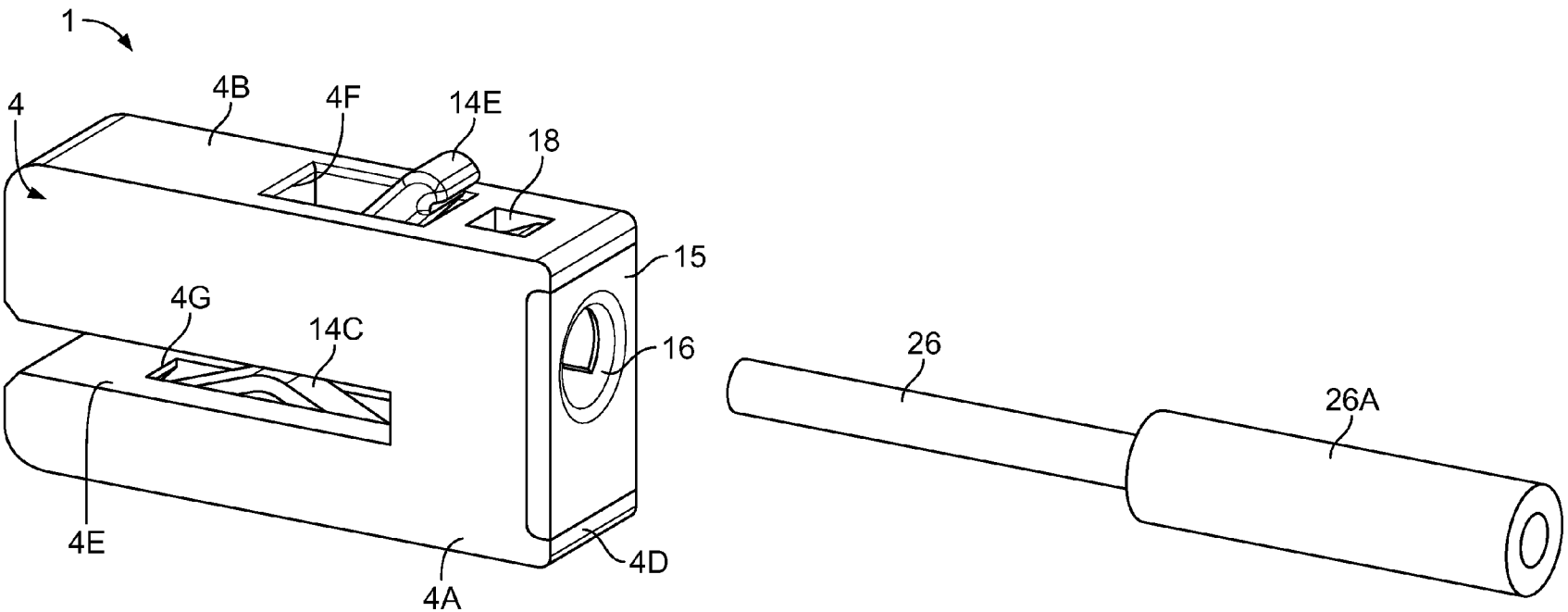
FIG. 5 is a perspective view of a connector according to a second embodiment of the invention.
Figure 6:
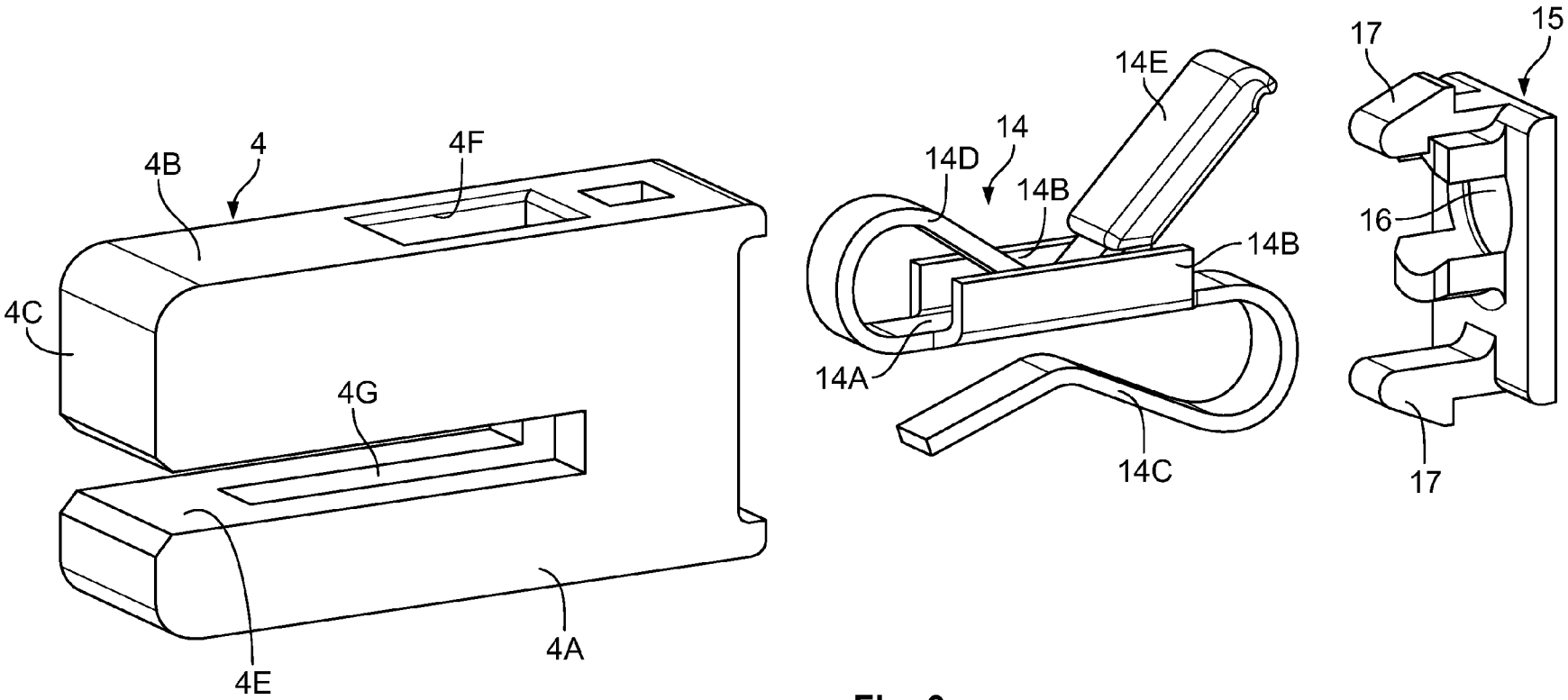
FIG. 6 is a perspective exploded view of the connector of FIG. 5.
Figure 7:
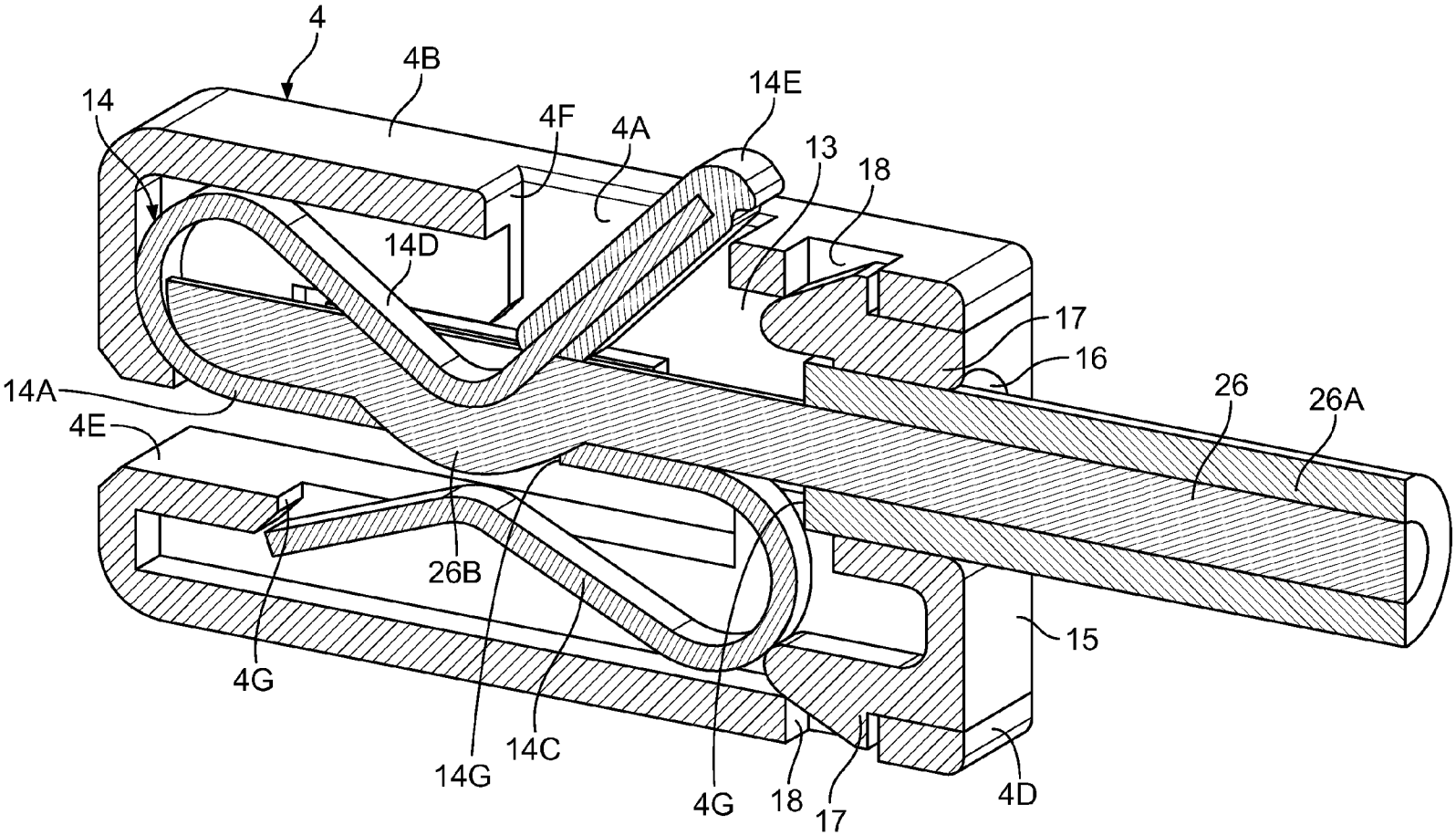
FIG. 7 is a sectional view of the connector of FIG. 5.

FIGS. 5-7 illustrate a second embodiment of the invention with reference to an electric connector for connecting an electric conductor to a bump contact 12A prearranged on a printed circuit board (PCB) 12. FIGS. 5-7 do not show the printed circuit board, but this can be seen in FIG. 8, which shows a variant of the solution of FIGS. 5-7 and provides an electric connector with a common casing capable of receiving a plurality of electric conductors and contacting them with a plurality of bump contacts 12A on the printed circuit board 12. The embodiment shown in FIGS. 5-7 relates to a connector with a casing for receiving a single electric conductor and contacting it with a respective bump contact of the printed circuit board.

Referring to FIGS. 5-7, number 1 denotes as a whole an electric connector comprising a plastics material casing 4 having a relatively flattened, substantially U-shaped body with two planar side faces 4A, an upper face 4B, a front face 4C and a rear face 4D. The U-shape of the body 4 defines a receptacle defined by mutually opposed planar faces 4E extending from the front face 4C, which makes it possible to mount the casing 4 over an edge 11 of a printed circuit board 12 (see FIG. 8) in such a way that the two mutually opposed faces 4E respectively contact the upper face of the printed circuit board (PCB) 12 comprising a respective bump contact 12A (similar to any one of the bump contacts 12A visible in FIG. 8) and the lower face of the PCB 12.

Referring to FIGS. 6 and 7 the casing 4 has an inner cavity 13 which receives a spring clip 14 formed by a bent-back metal strip having an intermediate portion 14A from which two lateral tabs 14B extend, a first end portion 14C with a V-shaped profile extending towards the intermediate portion 14A and cooperating therewith to resiliently hold the casing 4 on the PCB 12, as well as a second end portion 14D which also has a V-shaped profile extending towards the intermediate portion 14A. The two end portions 14C, 14D are connected to the intermediate portion 14A by curved portions so as to give the clip 14 a generally S-shaped configuration. The end of the end portion 14D is provided with a grasping nub 14E. The clip 14 is received inside the cavity 13 in the casing 4 and is held therein by a cover 15 having an opening 16 for the introduction of the sheath of the electric conductor and two resiliently deformable teeth 17 for engagement in cooperating openings 18 in the casing 4 (FIG. 7).

As can be seen in FIG. 7, the clip 14 is received inside the cavity 13 with the end portion 14C in contact with the inner face of the lower wall of the casing, and with the end portion 14D having its curved connection portion in contact with the inner face of the upper wall of the casing and the end nub 14E extending outside the casing through an opening 4F in the upper wall of the casing.

The electric conductor 26, which is formed for example by a strand of copper wires, is received together with the respective insulating sheath 26A inside the casing 4 through the opening 16. The portion of electric conductor 26 protruding axially from the sheath 26A is engaged by the upper end portion 14D of the spring clip 14 and is thereby forced against the upper face of the PCB 12 which is received in the receptacle defined between the two mutually opposed faces 4E of the casing, the lower face of the PCB 12 in turn being pressed by the lower end portion 14C. The mutually opposed walls 4E defining the receptacle for the PCB 12 have openings 4G to allow the portions 14C, 14D of the spring clip 14, together with the deformed portion 26B of the electric conductor 26, to press against the opposite faces of the PCB 12. Furthermore, the intermediate portion 14A, which acts as a support for the portion of electric conductor 26, has an opening 14G to allow the portion 26B to protrude below the portion 14A, pushed by the portion 14D of the clip, which acts as a retaining portion for the electric conductor 26.

However, as can also be seen in the solution of FIGS. 5-7, the electric conductor 26 is in direct contact with its counterpart formed by a respective metal bump contact 12A of the PCB 12. The nub 14E is grasped so as to lift upwards, with reference to the drawings, the end portion 14D of the spring clip 14 so as to bring it into a loaded state in which it is possible to insert the electric conductor 26 over the intermediate supporting portion 14A. Once the conductor 26 has been fully inserted inside the casing 4, the nub 14E is released, the end portion 14D thus engaging the electric conductor 26, pushing it through the opening 14G towards the PCB 12 and holding it in contact with the respective bump contact 12A. FIG. 7 shows the portion 26B of the conductor 26 which is completely deformed inside the receptacle, since the PCB is not shown in this figure. If the PCB 12 has been prearranged inside the casing 4, the end portion 14D of the spring clip 14 simply presses the portion 26B against the upper face of the PCB 12, whilst the end portion of the spring clip 14 presses against the lower face 14C of the PCB 12. The connection is thus ensured with direct contact between the electric conductor 26 and the bump contact 12A prearranged on the PCB.

Figure 8:
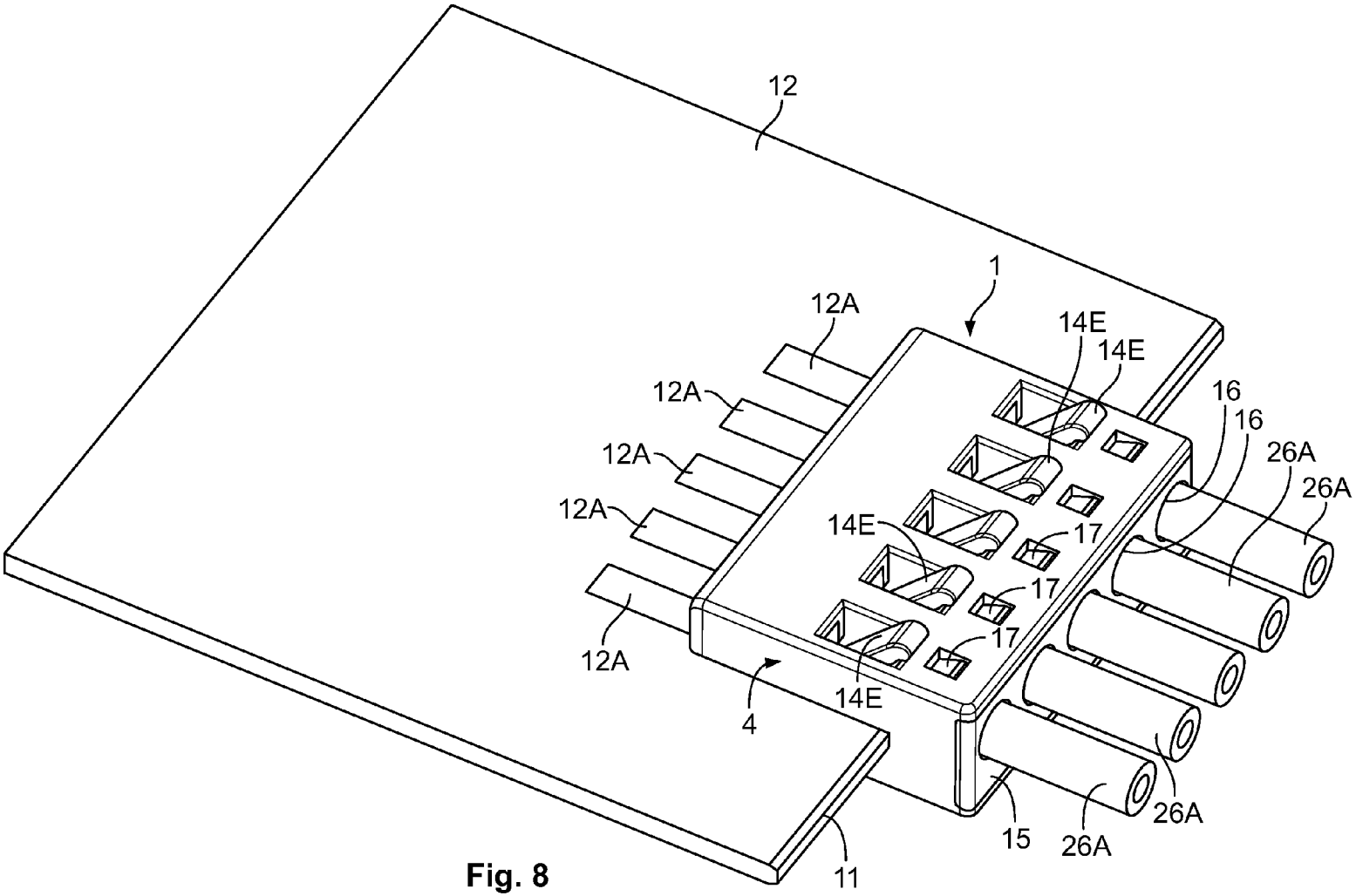
FIG. 8 shows a variant of the connector of FIG. 5 for connecting more electric conductors to contact elements prearranged on a printed circuit board.

FIG. 8 shows a variant of the embodiment of FIGS. 5-7 which differs therefrom merely in that the connector 1 comprises a casing 4 which is prearranged with a plurality of cavities for receiving a plurality of electric conductors 26 to be placed in contact with a plurality of bump contacts 12A on the upper face of the PCB 12. For this purpose a plurality of spring clips 14 of the type described above is arranged inside the cavity in the casing 4, each of which has a respective nub 14E which can be engaged so as to allow the insertion and subsequent locking of a respective electric conductor 26. The electric conductors 26, together with the respective sheaths 26A, are inserted into the common casing 4 through respective holes 16 in a common cover 15 which is mounted on the rear wall of the casing 4.

Figure 9:
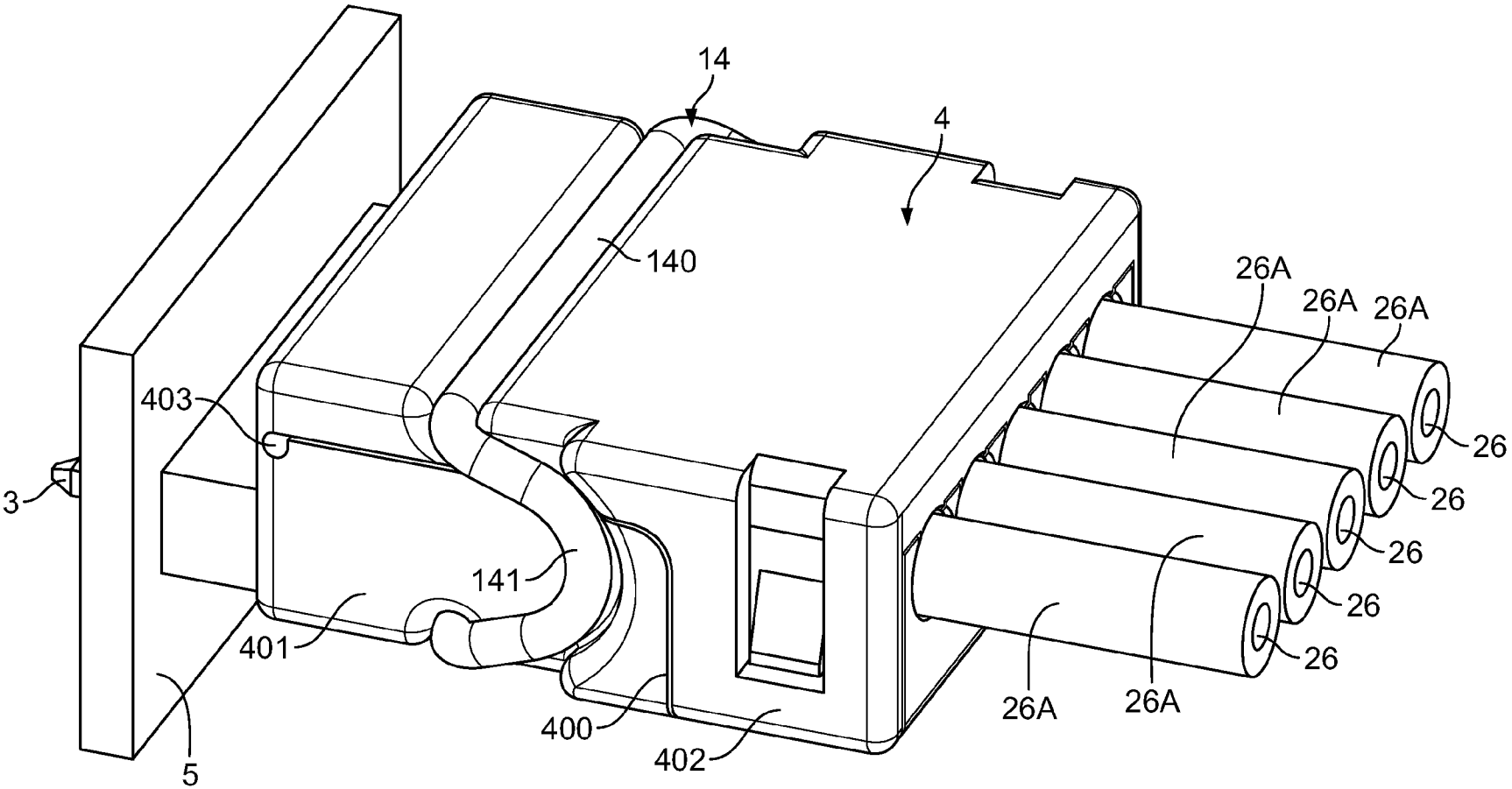
FIG. 9 shows a perspective view of a third embodiment of the connector according to the invention.
Figure 10:
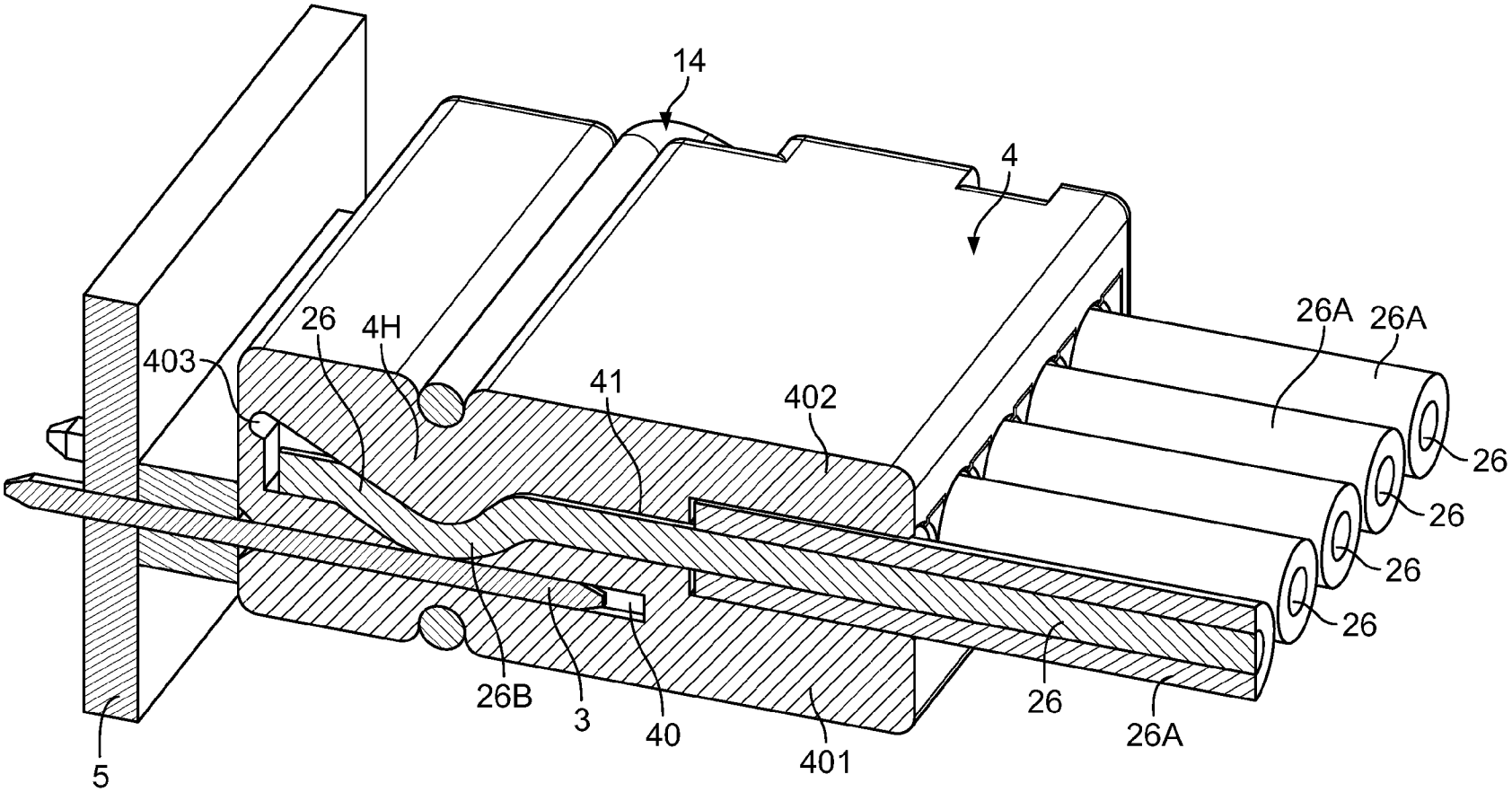
FIG. 10 is a sectional view of the electric connector of FIG. 9.
Figure 11:
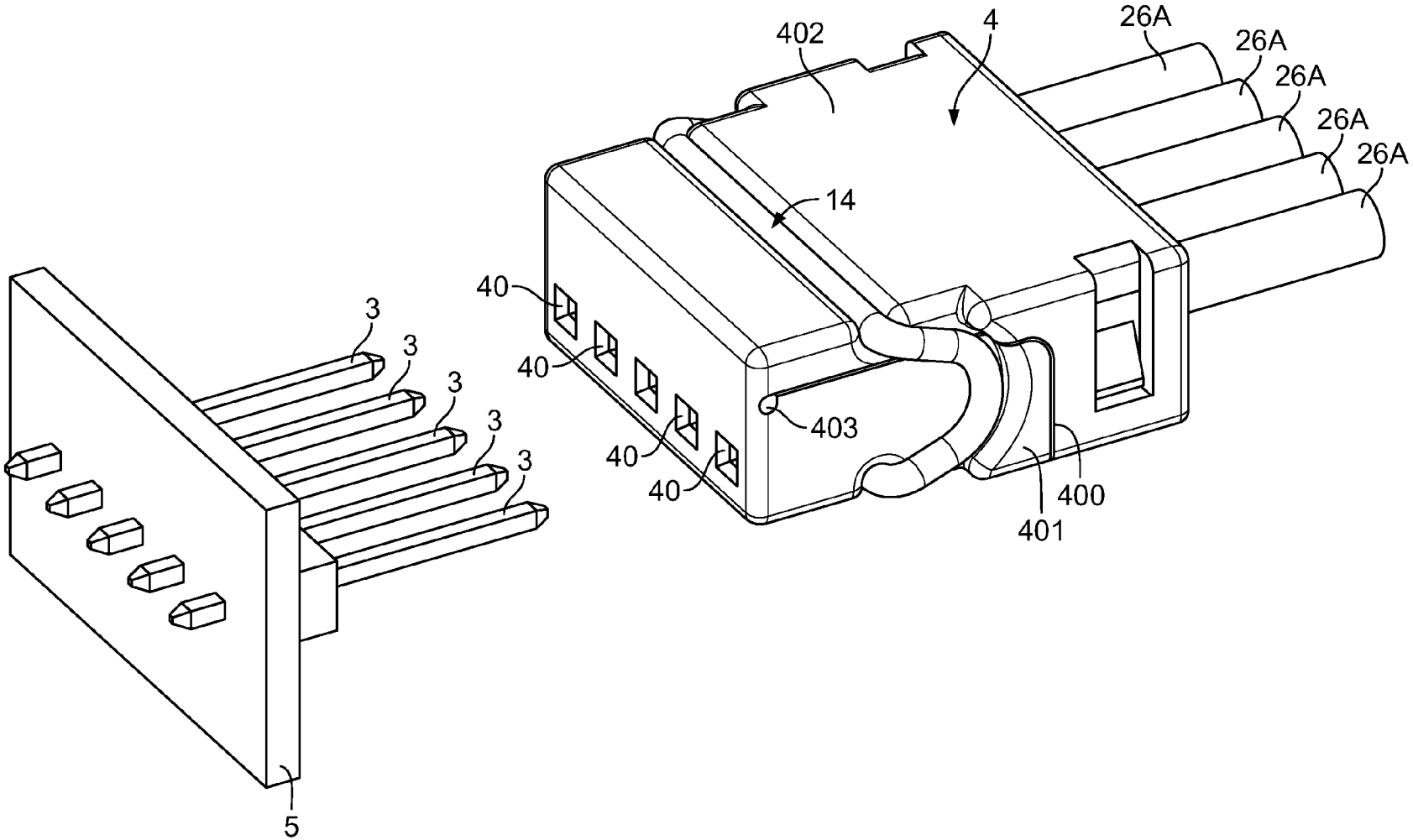
FIG. 11 is an exploded perspective view of the connector of FIG. 9.

FIGS. 9-11 show a further embodiment of the electric connector according to the invention, in which a single casing 4 is provided and is equipped with a single spring clip 14 which is mounted outside the casing 4 for the connection of a plurality of electric conductors 26, each provided with a respective insulating sheath 26A, to respective counterparts formed by contact plugs 3 carried by an insulating member 5 in the form of a plate.

As can be seen in particular in FIGS. 10 and 11, the plastics material body of the casing 4 has a plurality of receptacles 40 for receiving respective contact plugs 3 and further has respective parallel longitudinal cavities 41 (FIG. 10) adjacent to the receptacles 40, in which cavities the electric conductors 26 are inserted.

The spring clip 14 externally engages a portion 4H of the casing 4 so as to push the portion 26B of each electric conductor 26 against the respective counterpart 3 (FIG. 10), remaining insulated against the electric conductors. In the example illustrated the casing 4 has a cut 400 which separates the body of the casing into two portions 401, 402, which are hinged together at 402 and are pressed by the spring clip 14 against the conductors 26 and their counterparts 3. In an alternative it is possible to provide a casing 4 in which the part 4H is deformable.

In the example illustrated the spring clip 14 is formed by a metal wire which is bent back in a U-shape and is arranged in a plane which is transverse to the longitudinal direction of the cavities 40, 41. The clip 14 has two main branches 140 extending above and below the casing 4 respectively and an intermediate portion 141 which is in turn bent back in a U-shape in a plane which is orthogonal to the plane in which the two branches 140 lie. The branches 140 terminate with free ends arranged on the side of the casing 4, which is not visible in the drawings.

As can be seen, in the solution of FIGS. 9-11 a single casing 4 is provided equipped with a single spring clip 14 to place a plurality of electric conductors 26 in direct contact with the respective counterparts 3.

Figure 12:
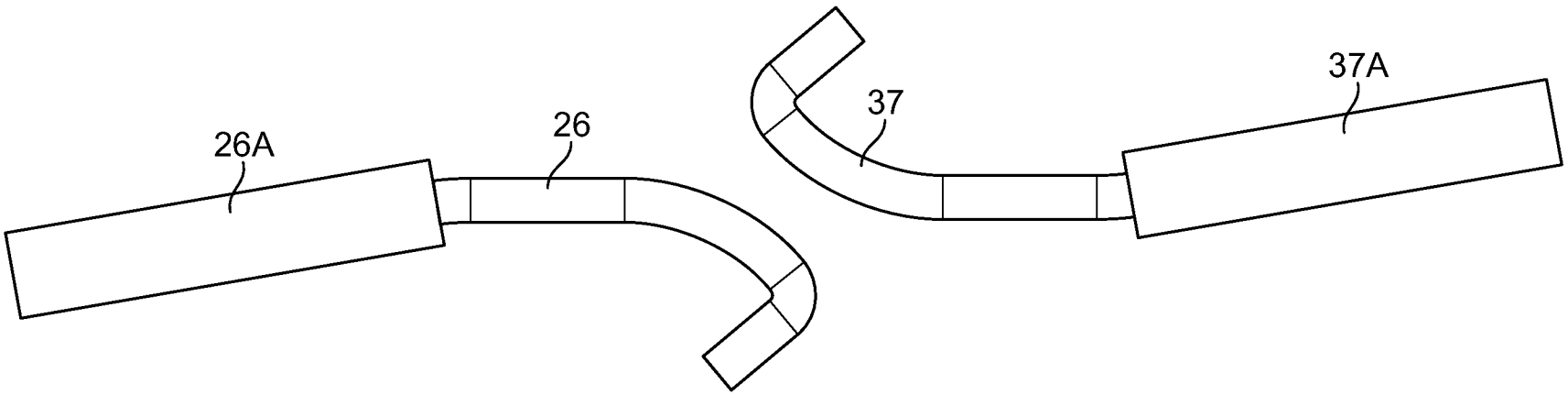
FIG. 12 shows two electric conductors with reference to a fourth preferred embodiment of the connector according to the invention.
Figure 13:
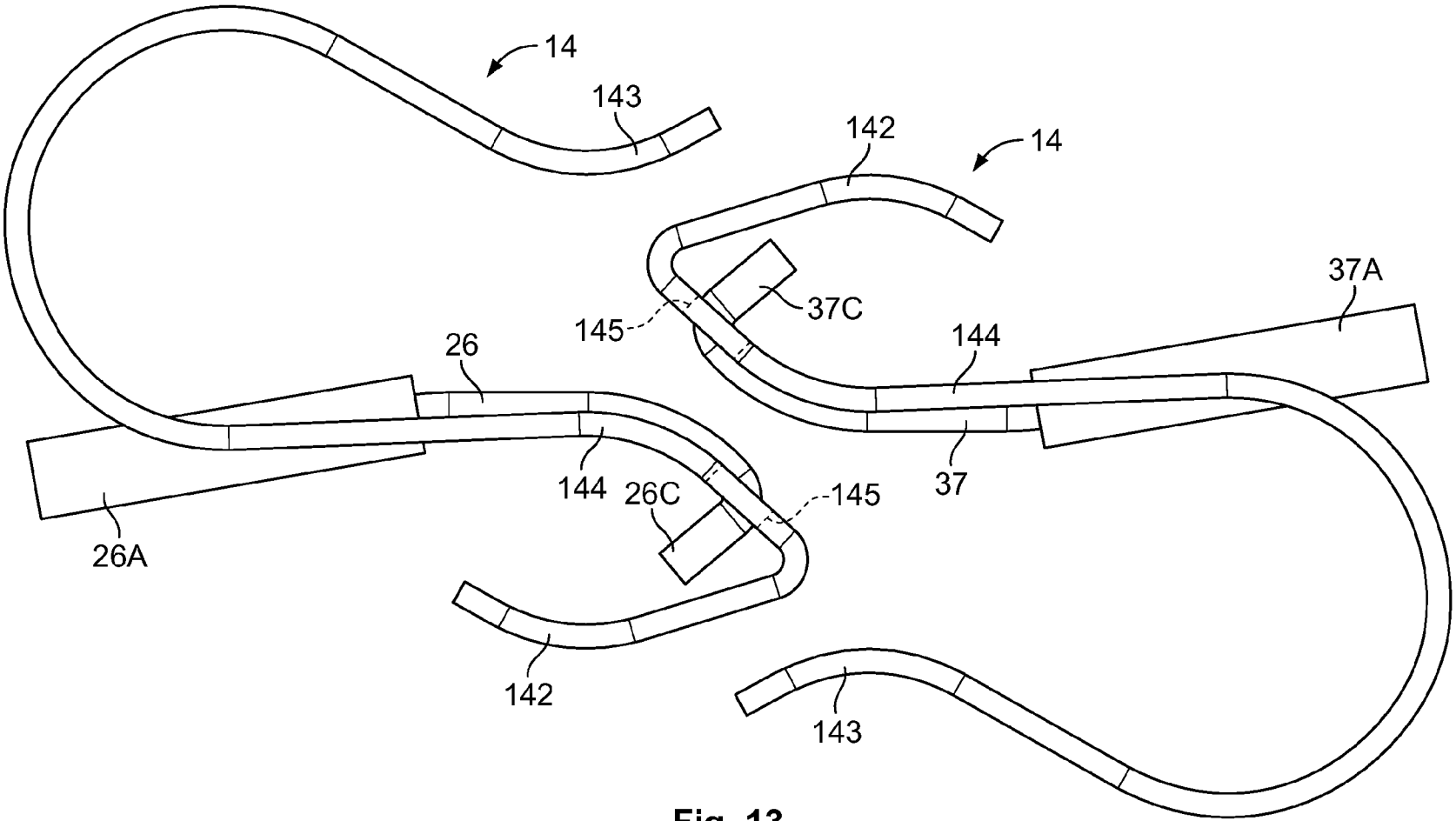
FIG. 13 shows the conductors of FIG. 12 with two respective associated spring clips.
Figure 14:
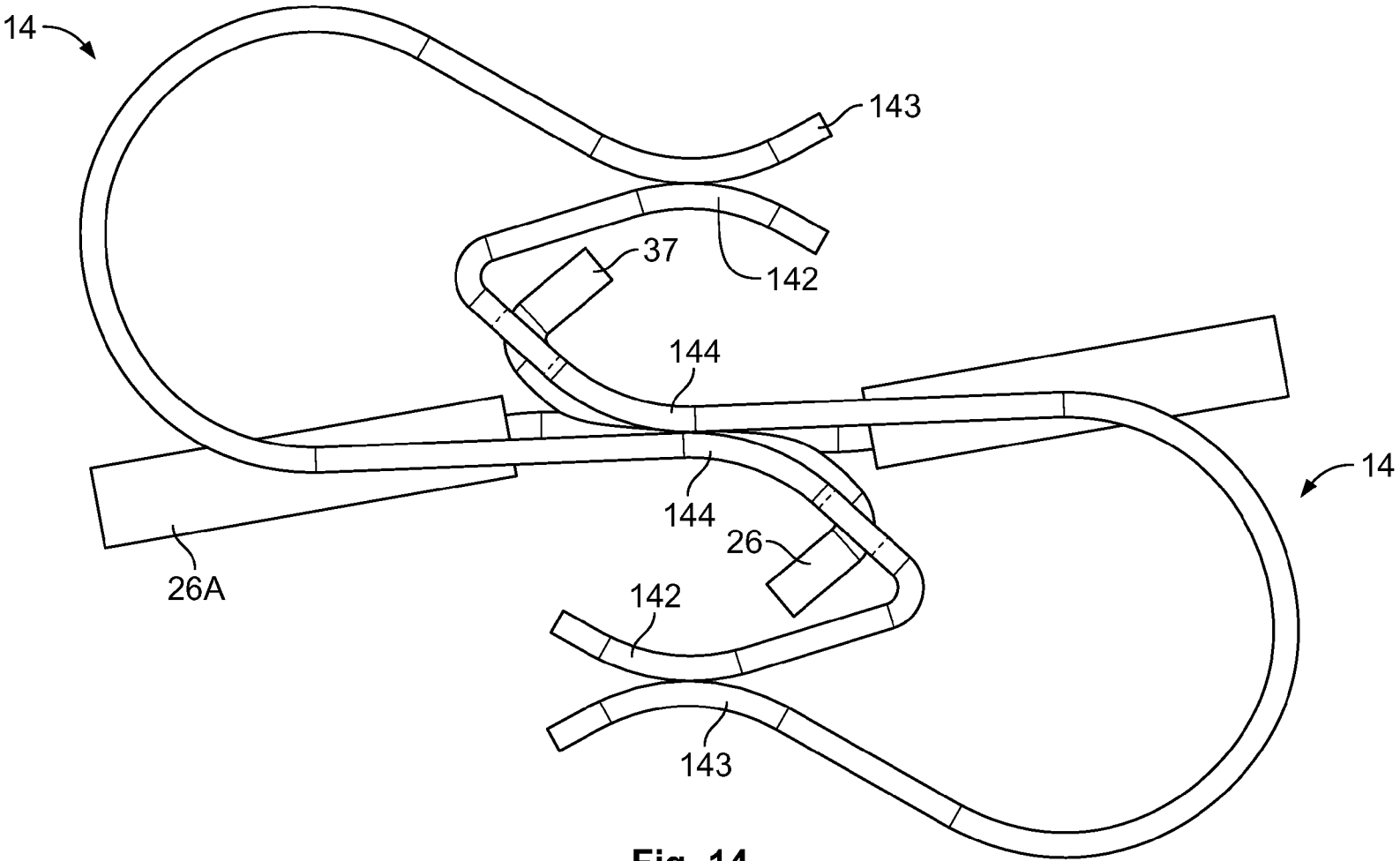
FIG. 14 is a schematic view which shows the two electric conductors and the two spring clips of FIG. 13 in the coupled state.

FIGS. 12-14 show a further embodiment in which the electric connector is completely devoid of a casing (although a casing could be provided, however) and in which the two contact elements of the connector are formed by electric conductors 26, 37 which are equipped with respective insulating sheaths 26A, 37A and are placed in direct contact with one another and held in this position by a pair of spring clips 14. As can be seen in FIGS. 13 and 14, the two spring clips 14 are generally S-shaped with intermediate portions 144 which are pressed towards one another so as to hold in contact therebetween the end portions of the electric conductors 26, 37, the ends 26C, 37C of the electric conductors being engaged through openings 145 in the metal strips, for example said openings being in the form of slots in which the electric conductors are pinched. As can be seen in FIGS. 13 and 14, the clips 14 further have end portions 142, 143 which are resiliently coupled to one another to hold the clips 14 above the coupling of the two electric conductors 26, 37. Of course, it would also be possible to provide a single spring clip 14 which is capable of holding the two electric conductors 26, 37 in engagement with one another.

As can be seen in the embodiment of FIGS. 12-14, the two metal contact elements are eliminated, the connector being formed merely by the spring clip which holds the electric conductors in direct contact with one another. In this case the "permanent" resistance is obviously completely eliminated in addition to the elimination of the "bulk" resistance.

As is evident from the description above, the electric connector according to the invention has a reduced electrical resistance owing to the elimination of the "bulk" resistance, which forms the majority of the electrical resistance of the connection, and also of the permanent resistance, at least in part. The bulk resistance is the main resistance responsible for the thermal effects originating from the passing of electric current. The permanent resistance may be unstable, which is why its elimination reduces the possibility of an electrically unstable connection. The advantage of a connection which exhibits greater mechanical stability within the range of operating temperatures is also obtained. The solution according to the invention provides the option of having a connection system which is self-supported by means of the spring clips and is not influenced by the plastics material casing. The casing is used merely to keep the electric conductor in the correct position.

The electric connector according to the invention is adapted for use within a wide range of applications.

Naturally, as long as the principle of the invention is adhered to, the construction details and embodiments may be varied from those described and illustrated, which are given purely by way of example, without thereby departing from the scope of the present invention.

The invention claimed is:

1. An electrical connector comprising a plurality of pairs of first and second contact elements which can be coupled to one another, each of the first contact elements being connected to a respective first electric conductor, and each of the second contact elements also being connected to a respective second electric conductor or else being a contact of a printed circuit board, and a common casing is provided which receives the first contact elements of the pairs, wherein the first contact elements are formed by a portion of the respective first electric conductors and said common casing is provided with a plurality of spring clips associated with the plurality of pairs of first and second contact elements to hold said first contact elements in direct engagement with the second contact elements, the electrical connector being profiled to pluggably receive the second contact elements into direct contact with the first contact elements.

2. The electrical connector according to claim 1, wherein said first contact clement is received inside a casing with which said spring clips are associated.

3. The electrical connector according to claim 1, wherein said second contact element is a contact of a printed circuit board, and said casing has a receptacle for receiving a portion of said circuit board and an opening from which an end of said spring clip emerges, said spring clip being movable between a loaded position, in which the clip allows insertion of said portion of electric conductor inside the casing, and a released position, in which the clip locks the portion of electric conductor inside the casing.

4. The electrical connector according to claim 1, wherein the spring clip is formed by a bent-back element defining a support portion for the conductor, said support portion being prearranged with an opening and a retaining portion capable of pushing said conductor against said support portion, making the retaining portion protrude through said opening.

5. Electric connector comprising:

at least one first and one second contact element which can be coupled to one another, the first contact element being connected to a respective electric conductor, and the second contact element also being connected to a respective electric conductor or else being a contact of a printed circuit board (PCB), the first contact element being formed by a portion of the respective electric conductor;

a spring clip to hold said portion of electric conductor in direct engagement with the further contact element; and a casing with which said spring clip is associated, and said electric conductor portion being received inside said casing; wherein the spring clip is formed by a bent-back element with a first end portion and a second end portion connected to an intermediate portion by curved portions so as to give the clip a generally S-shaped configuration, said intermediate portion defining a support portion for the conductor constituting said first contact element, said support portion being provided with an opening, said second end portion acting as a retaining portion capable of pushing said conductor against said support portion, making it protrude through said opening towards said second contact element, and said first end portion being in contact with an inner face of said casing.

6. Electric connector according to claim 5, wherein a plurality of pairs of said first and second contact elements is provided, and a common casing is provided which receives the portions of electric conductor of the various pairs.

7. Electric connector according to claim 6, wherein said common housing is provided with a plurality of spring clips associated with the various pairs of said first and second contact elements.

8. Electric connector according to claim 5, wherein said second contact element is a contact of a printed circuit board (PCB), and said casing has a receptacle for receiving a portion of said circuit board and an opening from which an end of said spring clip emerges, said spring clip being movable between a loaded position, in which the clip allows insertion of said portion of electric conductor inside the casing, and a released position, in which the clip locks the portion of electric conductor inside the casing.

9. Electric connector according to claim 5, wherein said first and second end portions are formed with V-shaped profiles arranged towards each other.

10. Electric connector according to claim 5, wherein said support portion is provided with two lateral tabs.

* * * * *